US005180889A

United States Patent [19]

Rogers et al.

[11] Patent Number: 5,180,889

[45] Date of Patent: Jan. 19, 1993

[54] CRUSH RESISTANT CABLE INSULATION

[75] Inventors: Charles E. Rogers, Somerville; Gertraud A. Schmidt, Red Bank, both of N.J.

[73] Assignee: Union Carbide Chemicals & Plastics Technology Corporation, Danbury, Conn.

[21] Appl. No.: 627,192

[22] Filed: Dec. 13, 1990

[51] Int. Cl.[5] ..... H01B 7/18

[52] U.S. Cl. ..... 174/113 R; 174/110 SR; 174/120 SR; 428/379; 428/380; 428/389; 428/391

[58] Field of Search ..... 428/379, 380, 372, 389, 428/383, 391; 174/110 SR, 120 SR, 113 R; 524/508, 515; 525/88, 89, 95, 196, 240, 314

[56] References Cited

U.S. PATENT DOCUMENTS

| | | | |
|---|---|---|---|
| 4,592,955 | 6/1986 | Choi et al. | 428/389 |
| 4,798,864 | 1/1989 | Toplik | 525/71 |
| 4,812,526 | 3/1989 | Rifi | 525/240 |
| 4,853,154 | 8/1989 | Icenogle et al. | 252/602 |
| 4,869,848 | 9/1989 | Hasegawa et al. | 252/609 |
| 4,876,147 | 10/1989 | Schlag et al. | 428/379 |
| 4,914,155 | 4/1990 | Shimomura et al. | 525/89 |
| 4,948,669 | 8/1990 | Rolland | 428/379 |
| 5,011,736 | 4/1991 | Abolins et al. | 428/407 |

FOREIGN PATENT DOCUMENTS 63-172753 7/1988 Japan .

OTHER PUBLICATIONS

Snyder et al., Elexar for Wire and Cable Applications, Scandinavian Rubber Conference, 1976.

*Primary Examiner*—Jenna L. Davis
*Assistant Examiner*—Christopher Brown
*Attorney, Agent, or Firm*—Saul R. Bresch

[57] ABSTRACT

A composition useful in the manufacture or cable comprising:

(i) a copolymer comprising ethylene and one or more alpha-olefins having a density equal to or less than 0.915 gram per cubic centimeter;

(ii) a metal hydrate flame retardant compound;

(iii) a styrene-ethylene-butylene-styrene triblock copolymer; and (iv) optionally, an impact polypropylene copolymer or polypropylene.

6 Claims, No Drawings

CRUSH RESISTANT CABLE INSULATION

TECHNICAL FIELD

This invention relates to a composition useful in the manufacture of crush resistant cable insulation.

BACKGROUND INFORMATION

The cable or wire of concern here is one having one or more electrical conductors as a center core, each conductor being surrounded by at least one insulating layer and, more particularly, a cable known in the trade as building wire, one type of which is also referred to as non-metallic sheathed cable. Because of its use in the construction of buildings, building wire is subjected to potential cut-through damage caused by fasteners such as staples and pressure from the materials of construction such as concrete and steel. The Underwriters' Laboratories, therefore, requires that non-metallic sheathed cable pass certain crush resistant tests without degradation of other physical properties. In addition to meeting these crush resistant requirements, the cable desirably has improved deformation and tensile strength properties, all without the necessity of being crosslinked.

DISCLOSURE OF THE INVENTION

An object of this invention, therefore, is to provide a composition, which is capable, in cable form, of meeting the Underwriters' Laboratories crush resistant requirements while retaining and/or improving upon other important physical properties.

Other objects and advantages will become apparent hereinafter.

According to the invention, a composition has been discovered, which meets the above objective. The composition comprises:

(i) a copolymer of a mixture comprising ethylene and one or more alpha-olefins having a density equal to or less than 0.915 gram per cubic centimeter;

(ii) a metal hydrate flame retardant compound;

(iii) a styrene-ethylene-butylene-styrene triblock copolymer; and (iv) optionally, an impact polypropylene copolymer or polypropylene.

DESCRIPTION OF THE PREFERRED EMBODIMENT

Component (i) can be a copolymer of ethylene and at least one alpha-olefin having 3 to 8 carbon atoms. The density of the copolymer is equal to or less than 0.915 gram per cubic centimeter and is preferably no lower than 0.870 gram per cubic centimeter. This very low density polyethylene is also referred to as VLDPE. It can be produced in the presence of a catalyst system containing chromium and titanium or a catalyst system containing a catalyst precursor comprising magnesium, titanium, a halogen, and an electron donor together with one or more aluminum containing compounds. The former can be made in accordance with the disclosure of U.S. Pat. No. 4,101,445 and the latter, which is preferred, can be prepared as described in U.S. Pat. No. 4,302,565. The melt index of the VLDPE can be in the range of about 0.1 to about 20 grams per 10 minutes and is preferably in the range of about 0.5 to about 10 grams per 10 minutes. the melt index is determined in accordance with ASTM D-1238, Condition E, measured at 190° C. Suitable alpha-olefin comonomers are exemplified by propylene, 1-butene, 1-hexene, 4-methyl-1-pentene, and 1-octene. The portion of the copolymer attributed to the comonomer, other than ethylene, i.e., the second comonomer, is in the range of about 5 to about 50 percent by weight based on the weight of the copolymer and is preferably in the range of about 10 to about 40 percent by weight. Where copolymers of three or more comonomers are desired, the portion derived from each of the additional comonomers (third, fourth, etc.) is usually in the range of about 1 to about 15 percent by weight.

The metal hydrate flame retardant compound can be any of those used conventionally such as magnesium hydroxide (magnesium hydrate) and aluminum hydroxide (alumina trihydrate). A particularly preferred magnesium hydroxide and a method for its preparation are described in U.S. Pat. No. 4,098,762. Characteristics of this magnesium hydroxide are (a) a strain in the $<101>$ direction of more than $3.0\times10^{-3}$; (b) a crystallite size in the $<101>$ direction of more than 800 angstroms; and (c) a surface area, determined by the BET method, of less than 20 square meters per gram.

The amount of metal hydrate used in the composition is in the range about 100 to about 650 parts by weight of metal hydrate per one hundred parts by weight Of VLDPE and is preferably in the range of about 200 to about 400 parts by weight of metal hydrate per one hundred parts by weight of VLDPE.

The metal hydrate is preferably surface treated with a saturated or unsaturated carboxylic acid having about 8 to about 24 carbon atoms and preferably about 12 to about 18 carbon atoms or a metal salt thereof. Mixtures of these acid and/or salts can be used, if desired. Examples of suitable carboxylic acids are oleic, stearic, palmitic, isostearic, and lauric; of metals which can be used to form the salts of these acids are zinc, aluminum, calcium, magnesium, and barium; and of the salts themselves are magnesium stearate, zinc oleate, calcium palmitate, magnesium oleate, and aluminum stearate. The amount of acid or salt can be in the range of about 0.1 to about 5 parts by weight of acid and/or salt per one hundred parts by weight of metal hydrate and preferably about 0.25 to about 3 parts by weight per one hundred parts by weight of metal hydrate. The acid or salt can be merely added to the composition in like amounts rather than using the surface treatment procedure, but this is not preferred.

Component (iii) is a styrene-ethylene-butylene-styrene triblock copolymer, a thermoplastic rubber. Polystyrene provides the two endblocks and poly (ethylene/butylene) provides the midblock. This thermoplastic rubber is preferably functionalized with, for example, maleic anhydride. The triblock copolymers referred to here are presently sold under the name KRATON TM by the Shell Chemical Company of Houston, Texas. They are based on about 13 to about 37 percent by weight styrene and about 67 to about 87 percent by weight of a mixture of ethylene and butylene. The midblock can be saturated or unsaturated. Component (iii) can be present in an amount of about 10 to about 200 parts by weight based on 100 parts by weight of VLDPE and is preferably incorporated into subject composition in an amount of about 25 to about 100 parts by weight.

Component (iv) can be an impact polypropylene copolymer or polypropylene. While the inclusion of component (iv) is optional, it is preferably included in the composition of the invention, and, it is further preferred that component (iv) be an impact polypropylene copolymer. An amount of up to about 200 parts by weight per 100 parts by weight of VLDPE can be used; however, a quantity in the range of about 25 to about 100 parts by weight is preferred. Impact polypropylene copolymers gener lly comprise a matrix of propylene homopolymer or copolymer of propylene and an alpha-olefin into which is incorporated a polymer such as an ethylene/propylene copolymer. It can be prepared by the process described in U.S. Pat. No. 4,882,380. Alternatively, polypropylene per se can be used as component (iv). The polypropylene can be a homopolymer of propylene or a random copolymer of propylene and one or more alpha-olefins having 2 or 4 to 12 carbon atoms, and preferably 2 or 4 to 8 carbon atoms.

Insofar as the impact polypropylene copolymer is concerned, the ethylene/propylene copolymer portion can be based on about 40 to about 70 percent by weight ethylene, the balance being propylene. When polypropylene per se is used, the amount of component (iii) is preferably increased to the upper end of its recited range.

The composition of this invention also preferably includes a coupling agent and one or more antioxidants. A coupling agent is a chemical compound, which chemically binds polymer components to inorganic components. Coupling is effected by a chemical reaction taking place at the temperatures under which the formulation is compounded, about 70° C. to about 180° C. The coupling agent generally contains an organofunctional ligand at one end of its structure which interacts with the backbone of the polymeric component and a ligand at the other end of the structure of the coupling compound which attaches through reaction with the surface of the filler. The following silane coupling agents are useful in subject composition: gamma-methacryloxypropyltrimethoxy silane; methyltriethoxy silane; methyltris (2-methoxyethoxy) silane; dimethyldiethoxy silane; vinyltris (2-methoxyethoxy) silane; vinyltrimethoxy silane; and vinyltriethoxy silane; and mixtures of the foregoing. A preferred silane coupling agent is a mixture of gamma-methacryloxypropyltrimethoxy silane and vinyltriethoxysilane. This mixture is described in U.S. Pat. No. 4,481,322.

The coupling agent can be used in an amount of about 0.5 part by weight to about 5 parts by weight for each 100 parts by weight of component (i). The effect can be maximized by the inclusion of suitable surfactants and free radical generators.

Examples of antioxidants are: hindered phenols such as tetrakis[methylene(3,5-di-tert-butyl-4-hydroxyhydrocinnamate)]methane and thiodiethylene bis(3,5-di-tert-butyl-4-hydroxy)hydrocinnamate; phosphites and phosphonites such as tris(2,4-di-tert-butylphenyl)-phosphite and di-tert-butylphenylphosphonite; various amines such as polymerized 2,2,4-trimethyl-1,2-dihydroquinoline; and silica. A tetrakis methane compound is preferred. Antioxidants are used in amounts of about 1 to about 5 parts by weight per hundred parts by weight of component(i).

Other useful additives for subject composition are surfactants, free radical generators, reinforcing filler or polymer additives, ultraviolet stabilizers, antistatic agents, pigments, dyes, slip agents, plasticizers, lubricants, viscosity control agents, extender oils, metal deactivators, water tree growth retardants, voltage stabilizers, flame retardant additives, smoke suppressants, and processing aids, e.g., metal carboxylates.

The Underwriters' Laboratories crush and deformation requirements for non-metallic shielded (NM) cable are set forth in UL Standard 719. This standard requires that a non-metallic shielded cable be able to withstand a crushing load without shorting (short circuiting) crush fixture to conductor or conductor to conductor of not less than (1) flatwise, 600 pounds, i.e., when a rigid one eighth inch diameter rod is pressed into the cable, which is laid flat on a steel plate and the rod and cable axes are at right angles, and (2) edgewise, 1200 pounds, i.e., when the cable is crushed between two flat, rigid, parallel, horizontal steel plates that are two inches wide, the cable axis being parallel to the two inch dimension and the major axis of the cable cross-section being perpendicular to the flat plates.

UL Standard 719 further requires that the insulated wire used in the cable have a deformation of 50 percent or less after one hour at a specified temperature under the pressure of a three eighths of an inch diameter presser foot with a 500 gram total weight. The test temperature is 113° C.

The components of subject composition can be blended in a batch type or continuous mixer. Magnesium hydroxide and granulated thermoplastic rubber tend to have poor flow characteristics, which can make it difficult or impractical to use continuous feeders, used together with continuous mixers, to achieve accurate proportions of all of the ingredients. Batch mixers offer the advantage of insuring correct proportions when the ingredients for each batch are individually weighed.

The composition, which is the subject of this invention, is advantageously used in a standard cable construction comprising (a) an assembly of three parallel electrical conductors, two of the conductors being coated with subject composition for the purpose of insulation; (b) one or more layers of paper surrounding component (a), the more layers the greater the crush resistance; (c) one or more layers (preferably four) of paper inside of component (b) and surrounding the conductor, which is not coated; and (d) a layer of subject composition surrounding component (b) as a jacket, sheath, or shield.

Advantages of the invention, in addition to increased crush resistance, are low deformation; improved surface smoothness and scratch resistance of the product, i.e., the insulating layer, which is usually extruded around the electrical conductor or a coated wire or cable; and improved ultimate tensile strength. These advantages are obtained without the degradation of other significant properties such as elongation and cold bend. Other advantages are low visible smoke, low corrosivity, and low toxicity.

The patents mentioned in this specification are incorporated by reference herein.

The invention is illustrated by the following examples.

EXAMPLES 1 TO 11

Brabender TM or Banbury TM mixers or a continuous mixer can be used. For these examples, a 40 pound Banbury mixer is selected.

The magnesium hydroxide is preferably loaded into the preheated mixer first. This is followed by the addition of the resins, the antioxidants, and the coupling agent. Adding the resins on top of a very light powder magnesium hydroxide tends to minimize dusting and subsequent loss of the magnesium hydroxide caused by the energetic action of the mixer rotors. It is found that it is beneficial to delay the addition of the antioxidants until after the coupling agents have reacted and effected a bond between the resins and the filler.

The ram of the mixer is brought down on top of the ingredients and the materials are mixed at a temperature sufficient to melt all of the resins and sufficient to allow the chemical reaction of the coupling agent to take place. The reaction initiation temperatures are generally in the range of about 175° C. to about 185° C. The mixing is continued for two to three minutes after these temperatures are attained at which time the batch is dropped out of the mixer and fed to an extruder and pelleting system to form pellets of convenient size for further processing.

In the Banbury mixer, the ram pressure and rotor speed (rpm) are varied to achieve reasonable fluxing (melting) time, usually about one minute; then a reasonable time to reach the coupling agent reaction temperature, usually about two minutes; followed by an about two to three minute mixing period where the temperature is controlled at a point above the reaction initiation temperature to insure that the desired reactions are complete, but below a temperature at which the components might degrade. Degradation temperatures are dependent on the specific components; in these examples, temperatures of less than about 200° C. are maintained; however, temperatures as high as about 226° C. have been found to yield acceptable results.

The ram pressures and rotor speeds vary between formulations depending on the relative ratio of resin and filler, the type of resin and filler, and the design and condition of the mixer. Useful rotor speeds prior to attaining the coupling agent reaction temperature are found to be between about 60 to about 90 rpm; useful rotor speeds to limit the temperature rise to desirable levels during the last two minutes of mixing are about 30 to about 50 rpm; and useful ram pressures are between about 50 to about 90 psig.

It is also beneficial to raise the ram once or twice in the first minute of mixing to allow the batch to settle in and fill the mixer (referred to as "turn over") and to sweep any of the components from the top of the ram back into the mixer. The ram is also raised to add the antioxidants if their introduction has been delayed until the coupling reaction is complete; then, the mixing is carried on for about two to three minutes more to insure a good dispersion of the antioxidants in the blend.

The components used in the examples are as follows:

1. VLDPE (a copolyaer of ethylene and 1-butene) having a density of 0.900 gram per cubic centimeter and a melt index of 0.35 to 0.45 gram per 10 minutes.

2. Impact polypropylene copolymer wherein the matrix is a homopolymer of propylene representing 75 percent by weight of the impact copolymer and, incorporated into the matrix, an ethylene/propylene copolymer representing the balance of the impact copolymer. The ethylene/propylene copolymer is based on 60 percent by weight ethylene and 40 percent by weight propylene.

3. The magnesium hydroxide is coated with about 2.5 percent by weight stearic acid based on the weight of the magnesium hydroxide. The magnesium hydroxide is made up of unagglomerated platelet crystals; the median particle size is about 1 micron and the maximum particle size, preferably less than about 5 microns.

4. The styrene-ethylene-butylene-styrene block copolymer is a thermoplastic rubber based on 29 percent by weight styrene and 71 percent by weight ethylene/-butylene mixture and having a density of 0.90 gram per cubic centimeter.

5. The coupling agent is an organosilicon compound.

6. Three antioxidants are used in each example as follows:

(i) tetrakis[methylene(3,5-di-tert-butyl-4hydroxyhydrocinnamate)]methane at 0.3 percent by weight;

(ii) distearylthiodipropionate at 0.3 percent by weight; and (iii) a hindered amine light stabilizer at 0.1 percent by weight.

The composition for each example is processed as described above using the above components.

Variable conditions and results are set forth in Table I.

TABLE I

| Example | VLDPE (% by wt) | polypropylene (% by wt) | thermoplastic rubber (% by wt) | $Mg(OH)_2$ (% by wt) | coupling agent (% by wt) | crush load (pounds) | tensile strength (psi) | elongation (%) |
|---|---|---|---|---|---|---|---|---|
| 1 | 40.1 | — | — | 59.0 | 0.2 | 548 | 1872 | 713 |
| 2 | 40.0 | — | — | 59.0 | 0.3 | 436 | 1859 | 715 |
| 3 | 30.0 | 5.0 | 5.0 | 59.0 | 0.3 | 517 | 1971 | 698 |
| 4 | 39.9 | — | — | 59.0 | 0.4 | 456 | 1833 | 694 |
| 5 | 29.9 | 10.0 | — | 59.0 | 0.4 | 454 | 1137 | 28 |
| 6 | 30.1 | 10.0 | — | 59.0 | 0.2 | 542 | 1168 | 13 |
| 7 | 20.1 | 20.0 | — | 59.0 | 0.2 | 528 | 1562 | 5 |
| 8 | 30.1 | — | 10.0 | 59.0 | 0.2 | 601 | 1943 | 636 |
| 9 | 29.9 | — | 10.0 | 59.0 | 0.4 | 524 | 1898 | 643 |
| 10 | 19.9 | 10.0 | 10.0 | 59.0 | 0.4 | 572 | 2009 | 639 |
| 11 | 20.1 | 10.0 | 10.0 | 59.0 | 0.2 | 642 | 2214 | 656 |

Notes to Table I:

1. The crush test is carried out by applying a weight on top of a simple sandwich arrangement of cable components as follows: two insulated copper conductors with a base conductor between them are laid parallel on a 0.030 inch thick tape of one of the example materials. A second tape of the same material is placed on top of the three parallel conductors and a layer of kraft paper typical of that used in non-metallic cable construction is placed between each tape and the three conductors.

The weight which drives a metal rod through the tape is increased until a short circuit is effected. The crush load is the weight required to cause the short circuit.

2. Tensile strength and percent elongation are determined under ASTM D-638.

EXAMPLES 12 TO 17

Flatwise crush tests are carried out in accordance with UL Standard 719 on various combinations of the formulations used in Examples 1, 8 and 11. The results are shown in Table II.

TABLE II

| Example | Insulation Formulation | Jacket Formulation | Crush Load Range (pounds) |
|---|---|---|---|
| 12 | 1 | 1 | 427 to 555 |

TABLE II-continued

| Example | Insulation Formulation | Jacket Formulation | Crush Load Range (pounds) |
|---|---|---|---|
| 13 | 1 | 8 | 497 to 556 |
| 14 | 1 | 11 | 494 to 601 |
| 15 | 8 | 8 | 635 to 640 |
| 16 | 11 | 11 | 515 to 706 |
| 17 | 11 | 1 | 628 to 658 |

Notes to Table II:
1. The Insulation Formulation number refers to the previous example in which the formulation is tested. This formulation is extruded around the conductor to form the insulating layer.
2. The Jacket Formulation number also refers to the previous example in which the formulation is tested. This formulation is extruded around the inner cable assembly, which is comprised of a pair of insulated conditions and a ground wire with its paper spacer.
3. Ten crush tests are carried out under each example to provide a range of values under crush load.

EXAMPLES 18 TO 20

The formulations for examples 18, 19 and 20 are the same as for examples 1, 8, and 11, respectively.

Two sets of crush data are generated.

For the first set, the formulations are extruded about 14 AWG (American Wire Gauge) copper wires to form a 31 mil thick coating on each wire. For the second set, the formulations are extruded to form 32 mil thick tapes.

The coated wire is laid on a thick steel plate and the tape is laid on a bare 14 AWG copper wire and this combination is also laid on a thick steel plate. ⅛ inch diameter metal rods are pressed into the coated wires and the tapes at 0.5 inch per minute until the rods contact the wire.

The crush loads are given in pounds and are set forth in Table III. Crush load is defined as the number of pounds of pressure required to force the rod through the coating or tape until it touches the wire.

TABLE III

| Example | Crush Load (pounds) | |
|---|---|---|
| | Coated Wire | Tape |
| 18 | 130 | 112 |
| 19 | 160 | — |
| 20 | 161 | 155 |

EXAMPLES 21 TO 27

The deformation test for insulated wires is described in Underwriters' Laboratories (UL) Standard 83, paragraph 39, and UL Standard 1581, paragraph 560. The deformation specifications for insulated wires used in NM cable are further defined in UL Standard 719, paragraph 5 (August 9, 1990 revision). Three formulations are extruded about 14 AWG copper wires to form a 30 mil thick coating on each wire. The percent deformation is measured for each coated wire at increasing temperatures. Formulation I is the same formulation as in example 1; Formulation II is the same formulation as in example and Formulation III is 20.1% by wt VLDPE, 15% by wt polypropylene, 5% by wt thermoplastic rubber, 59% by wt $Mg(OH)_2$, and 0.2% by wt coupling agent, all as defined above for examples 1 to 11.

The temperature in degrees Centigrade and the percent deformation at each temperature are set forth in Table IV.

TABLE IV

| Example | Temperature | Deformation (%) | | |
|---|---|---|---|---|
| | | Formulation I | Formulation II | Formulation III |
| 21 | 105 | 26.5 | — | 10 |
| 22 | 112 | 46.7 | — | 16.4 |
| 23 | 115 | 65.6 | 30.8 | 19.9 |
| 24 | 118 | — | 38.3 | 19.7 |
| 25 | 119.5 | — | — | 26.8 |
| 26 | 121 | — | 53.3 | — |
| 27 | 122 | — | — | 32.8 |

We claim:

1. A cable construction having a flatwise crush resistance of at least 600 pounds and an edgewise crush resistance of at least 1200 pounds comprising:
   (a) an assembly of three parallel electrical conductors, two of the conductors being coated with the following non-crosslinked composition:
      (i) a copolymer comprising ethylene and one or more alpha-olefins having 3 to 8 carbon atoms, said copolymer having a density in the range of 0.870 to 0.915 gram per cubic centimeter and, based upon 100 parts by weight of component (i):
      (ii) a surface treated metal hydrate flame retardant compound in an amount of about 200 to about 400 parts by weight;
      (iii) a styrene-ethylene-butylene-styrene triblock copolymer in an amount of about 25 to about 100 parts by weight;
      (iv) an impact polypropylene copolymer in an amount of about 25 to about 100 parts by weight; and
      (v) an organosilane coupling agent in an amount of about 0.5 to about 5 parts by weight;
   (b) one or more layers of paper surrounding component (a);
   (c) one or more layers of paper inside of component (b) and surrounding the conductor, which is not coated; and
   (d) a layer of said non-crosslinked composition surrounding component (b).

2. The cable construction defined in claim 1 wherein the paper is Kraft paper.

3. The cable construction defined in claim 1 wherein component (a)(ii) is $Mg(OH)_2$ or $Al(OH)_3$.

4. The cable construction defined in claim 1 wherein component (a)(iii) is based on about 13 to about 37 percent by weight styrene and about 63 to about 87 percent by weight of a mixture of ethylene and butylene.

5. The cable construction defined in claim 1 wherein component (a)(iv) is an impact polypropylene copolymer having a matrix of a homopolymer of propylene and, incorporated into said matrix, an ethylene/propylene copolymer.

6. The cable construction defined in claim 1 wherein component (a)(ii) has been surface treated with a saturated or unsaturated carboxylic acid.

* * * * *